United States Patent [19]

deLarosiere

[11] 4,410,099

[45] Oct. 18, 1983

[54] CASE FOR MULTIPACKS OF BOTTLES

[75] Inventor: Pierre J. deLarosiere, Lisbon, Portugal

[73] Assignee: International Container Systems, Inc., Tampa, Fla.

[21] Appl. No.: 326,131

[22] Filed: Nov. 30, 1981

[51] Int. Cl.[3] ..... B65D 10/24; B65D 21/02; B65D 25/10

[52] U.S. Cl. ..... 220/21; 206/427; 206/509

[58] Field of Search ..... 220/21, DIG. 15; 206/427, 509, 511

[56] References Cited

U.S. PATENT DOCUMENTS

| | | | |
|---|---|---|---|
| Re. 29,262 | 6/1977 | Utz | 220/21 |
| 2,407,079 | 9/1946 | Howard | 220/21 |
| 2,459,921 | 1/1949 | Comer | 220/21 |
| 2,603,377 | 7/1952 | Mayers et al. | 217/19 |
| 2,821,327 | 1/1958 | Glazer . | |
| 2,918,379 | 12/1959 | Lurie | 99/174 |
| 3,039,651 | 6/1962 | Lang . | |
| 3,045,863 | 7/1962 | De Chelbor . | |
| 3,171,562 | 3/1965 | Weiss | 217/26.5 |
| 3,178,052 | 4/1965 | Bromley . | |
| 3,206,020 | 9/1965 | Billingsley et al. . | |
| 3,357,625 | 12/1967 | Malmgren | 229/2.5 |
| 3,428,207 | 2/1969 | Schoeller | 220/21 |
| 3,517,852 | 6/1970 | Schoeller | 220/21 |
| 3,791,549 | 2/1974 | Delbrouck | 220/21 |
| 3,842,976 | 10/1974 | Dea | 206/203 |
| 3,863,759 | 2/1975 | Prodel | 206/203 |
| 3,912,075 | 10/1975 | Berry | 206/427 |
| 4,032,007 | 6/1977 | Graser | 206/427 |
| 4,042,108 | 8/1977 | Brethauer | 206/509 |
| 4,071,162 | 1/1978 | Steinlein et al. | 220/21 |
| 4,162,738 | 7/1979 | Wright | 220/21 |
| 4,249,671 | 2/1981 | Crolli | 220/469 |
| 4,269,309 | 5/1981 | Prodel | 220/21 |
| 4,319,685 | 3/1982 | David | 220/21 |

FOREIGN PATENT DOCUMENTS

| | | | |
|---|---|---|---|
| 1255160 | 1/1961 | France . | |
| 1320916 | 2/1963 | France . | |
| 1366608 | 6/1964 | France . | |
| 478031 | 10/1969 | Switzerland . | |
| 758517 | 3/1954 | United Kingdom . | |
| 1152038 | 5/1969 | United Kingdom | 220/21 |

*Primary Examiner*—George E. Lowrance
*Attorney, Agent, or Firm*—Pennie & Edmonds

[57] ABSTRACT

A case for unsupported-base multipacks of bottles has an outer wall, a base grid comprising a plurality of interconnected ribs, and partitioning to divide the case into a plurality of multipack receptacles. Each multipack receptacle has a generally hollow supporting pillar projecting from the base grid of the receptacle. The supporting pillar can fit within a space between four bottles of a multipack placed within the receptacle and urge against a side portion of each of the bottles to stabilize the multipack. Empty cases of the invention can nest one on top of the other with each supporting pillar of a lower case extending into the hollow interior of a corresponding supporting pillar of the next higher case. A case rest surface of the base grid of the case has plurality of indentations in it which define closure-locating dimples. Cases of the invention loaded with multipacks of bottles can be arranged in multilayered stacked and cross-stacked structures with the closures of bottles of lower cases being located within the closure-locating dimples of cases immediately above.

6 Claims, 6 Drawing Figures

CASE FOR MULTIPACKS OF BOTTLES

DESCRIPTION

TECHNICAL FIELD

The present invention relates to a reusable plastic case for multipacks of bottles.

BACKGROUND ART

Bottled beverages are widely sold in groups of bottles termed "multipacks." In the past such multipacks conventionally included a group of bottles of beverages, typically six, packaged in a paper-board carton having a handle or finger holes which enabled a purchaser to carry the multipack. More recently, as an alternative to multipacks packaged in paper-board containers, unsupported-base multipacks of bottles have been used. In typical unsupported-base multipacks, a plastic bottle holder removably grips upper portions of the bottles of the multipack to enable the bottles to be carried. Such a multipack is shown in FIG. 1. A six-pack of bottles 2 includes six bottles 4 and a bottle holder 6. The bottle holder 6 is a molded plastic structure having six bottle-grip openings passing through it through which the necks of the bottles 4 extend. The bottles 4 are held in place at their necks by the bottle holder 6. The bottle holder 6 has finger holes 8 which enable the six-pack 2 to be carried. When the six-pack is lifted by the bottle holder 6, the bases of the bottles 4 are unsupported. Because the bottle holder 6 is somewhat flexible, the bottles 4 can pivot in the bottle-grip openings of the holder. This ease of pivoting has given rise to problems in warehousing unsupported-base multipacks.

Heretofore, bottlers have ordinarily packed unsupported-base multipacks of bottles in corrugated paper cartons for warehousing and shipment to retailers. For efficient storage in a warehouse, cartons of multipacks must be stacked in multi-tiered structures. When cartons of multipacks are stacked, the lower cartons must bear the weight of the upper cartons. A beverage bottle can bear a surprisingly high compressive load applied between a closure and a base of the bottle if the load is directed substantially along an axial symmetry axis of the bottle. Consequently, to permit cartons to be stacked, a corrugated-paper carton for unsupported-base multipacks transmits the load of a weight on the top of the carton to the closures of the bottles in the carton. However, if the bottles in one carton in a stack of cartons become tilted, the entire stack can become unstable and collapse. As noted above, the bottle holders of typical unsupported-base multipacks do not prevent the bottles in the multipacks from pivoting. Corrugated paper cartons can be relatively easily deformed, particularly in humid climates, which permits bottles in multipacks contained in the cartons to pivot and become tilted. Consequently, bottlers have had to limit the height of the stacks of cartons of unsupported-base multipacks, with the result that greater warehouse floor space is required to store the multipacks than would be required if higher stacks were more stable.

Increasing the guage of the corrugated paper of the cartons can reduce the problem of bottles tilting in the cartons. However, the greater the guage of the corrugated paper in a carton, the more expensive the carton. Since the cartons are used only once and then discarded by the retailer, the cost of the cartons is a significant expense to the bottler. Consequently, increasing the guage of the corrugated paper of the cartons is not a satisfactory solution to the problem of bottles tilting in the cartons.

Corrugated-paper cartons have an additional disadvantage of obscuring the labels of the bottles packaged in the cartons. Thus corrugated-paper cartons are generally unsuitable for displaying multipacks of bottles at a retail store.

U.S. Pat. No. 4,071,162 to Steinlein and Schoeller discloses a crate for storing both bottles contained in bottle packs and empty bottles without packs. The bottle packs are of a base-supporting type and have partitions which separate the bottles in the pack from one another. The crate includes clusters of pillars extending upward from the bottom of the crate. Each cluster is centered on the intersection of four bottle cells of the crate. The pillars of the same cluster are separated by one or two vertical slot-like gaps extending to the bottom of the crate. The bottom of the bottle pack is provided with holes to allow the pillars of the crate to extend up into the bottle pack. The partitions of the bottle pack fit within the slot-like gaps separating the pillars. The clusters of pillars hold bottles in the crate when the bottles are in bottle packs and when the crate is used for empty bottles without packs. The crate has side walls and end walls which extend upward from the bottom of the crate a distance greater than the height of the pillars. Because of the high side walls and the slot-like gaps of the clusters of pillars, empty crates cannot be efficiently nested one inside the other. Consequently, if a bottler were to use the crates of the —162 patent to ship packs of disposable bottles to a retailer, substantially the same shipping volume would be required to return the empty crates to the bottler, a significant drawback.

DISCLOSURE OF THE INVENTION

I have invented a reusable plastic case for storing and transporting unsupported-base multipacks of bottles which permits stable stacking of cases of multipacks of bottles and which permits empty cases to be nested efficiently, and which avoids problems of the prior art noted above.

The invention will be described in terms of a preferred case for carrying four unsupported-base six-packs of bottles, although it will be appreciated that the principles of the invention embodied in the case described can be readily applied to cases configured to carry multipacks other than six-packs and to carry other than four multipacks.

The case of the invention has a generally rectangular outer wall which encloses an area sufficient to encompass four six-packs of bottles.

The case includes a base grid which comprises a plurality of ribs interconnected to form a grid network. A first side of the base grid defines a bottle-support surface. The opposite side of the base grid defines a case-rest surface. The outer wall is connected to the base grid generally along a perimeter of the base grid and projects generally away from the base grid in a case-upright direction. An outer-wall limit plane is defined to be a lowest horizontal plane which the outer wall does not extend above when the case is resting on a horizontal surface. The case-support surface of the base grid has 24 indentations in it which define closure-locating dimples. Each closure-locating dimple is shaped to receive a top portion of a bottle closure. The closure-locating dimples are located substantially at vertex points of squares of a square lattice defined in fixed relation to the outer wall. The squares of the lattice are dimensioned to correspond substantially to the spacing of the bottles in a six-pack.

The case of the invention also includes two case partitions connected to the base grid and the outer wall which divide the case into four six-pack receptacles. Eack six-pack receptacle is shaped to receive the bases of the bottles of a six pack, with a center line of each bottle at least approximately passing through a vertex point of the lattice of vertex points. The outer wall is shaped relative to the lattice of vertex points to permit a plurality of cases loaded with six-packs to be arranged in a multi-layered cross-stacked structure with the closures of the bottles of the cases of a lower layer being located in the closure-locating dimples of the cases in the next higher level.

The case also includes a plurality of supporting pillars. Each six-pack receptacle includes a supporting pillar located within the receptacle substantially at a center of a square of the lattice of vertex points. The supporting pillars are connected to the base grid and project generally away from the base grid in the case-upright direction to a point beyond the outer-wall limit plane. Each supporting pillar is shaped and dimensioned to fit within a space between four bottles of a six-pack inserted in the corresponding six-pack receptacle and to urge against a side portion of each of the four bottles to stabilize the six-pack. Crosswise dimensions of each supporting pillar generally decrease as the distance from the base grid increases. The supporting pillars are generally hollow. Corresponding to each supporting pillar is a pillar-insert opening passing through the base grid which provides communication with the hollow interior of the pillar. The supporting pillar and the pillar-insert openings are shaped so that empty cases of the invention may be nested one on top of the other with each supporting pillar of a lower case projecting through a pillar-insert opening and into the hollow interior of a corresponding supporting pillar of the upper case.

When a six-pack is inserted in a six-pack receptacle of a case of the invention, the receptacle tends to hold the bases of the bottles in place. The supporting pillar of the receptacle tends to orient the bottles in the case-upright direction and prevent them from becoming tilted. Consequently, a case of the invention loaded with four six-packs of bottles is a stable structure which can be stacked in both column and cross-stacked arrangements.

The stability of the stacks of cases of the invention loaded with multipacks is enhanced by the closure-locating dimples, which tend to lock the cases in a stack in a fixed lateral position. Lateral shifting of the cases is substantially prevented. Moreover, the closure-locating dimples tend to insure that the weight of upper cases in a stack is directed to the tops of bottles of the lower cases along the symmetry axes of the bottles.

The cases of the present invention can be nested efficiently when empty. In a preferred embodiment of the present invention, for example, each case in a stack of empty cases represents roughly one-fifth of the height of a bottle.

When a multipack of bottles is being inserted into a multipack receptacle of a case of the present invention, the supporting pillar tends to guide the multipack to the proper location, thereby facilitating loading of the case.

In a preferred embodiment of the invention, the bottle support surface of the base grid is substantially planar. Alternatively, indentations shaped complementary to the bases of the bottles can be formed in the bottle support surface of the base grid to locate and fix the positions of the bases of the bottles.

Cases of the invention are preferably unitary molded structures manufactured by a conventional injection molding process. A preferred plastic material out of which to manufacture the case is polyethylene. Cases of the invention preferably have a low profile, which minimizes the quantity of material which must be used to manufacture the case.

The low profile of preferred cases of the invention permits the labels of the bottles in the cases to be displayed. Thus cases of the invention are suitable for displaying multipacks of bottles in retail stores. Since the cases of the invention are molded from a plastic material, they can be colored as desired to enhance visual appeal and for product identification. Trade names, logos, and the like can be imprinted the outer wall of the case, if desired.

The cases of the invention are rugged and can be used repeatedly. Thus, although cases of the invention are generally more expensive initially than typical corrugated-paper cartons now employed for packaging unsupported-base multipacks of bottles, over their useful life, cases of the invention are more economical to use for storing and shipping multipacks of bottles.

BRIEF DESCRIPTION OF THE DRAWINGS

Preferred embodiments of the invention are described below with reference to the following drawings.

BEST MODE FOR CARRYING OUT THE INVENTION

Figure 1:
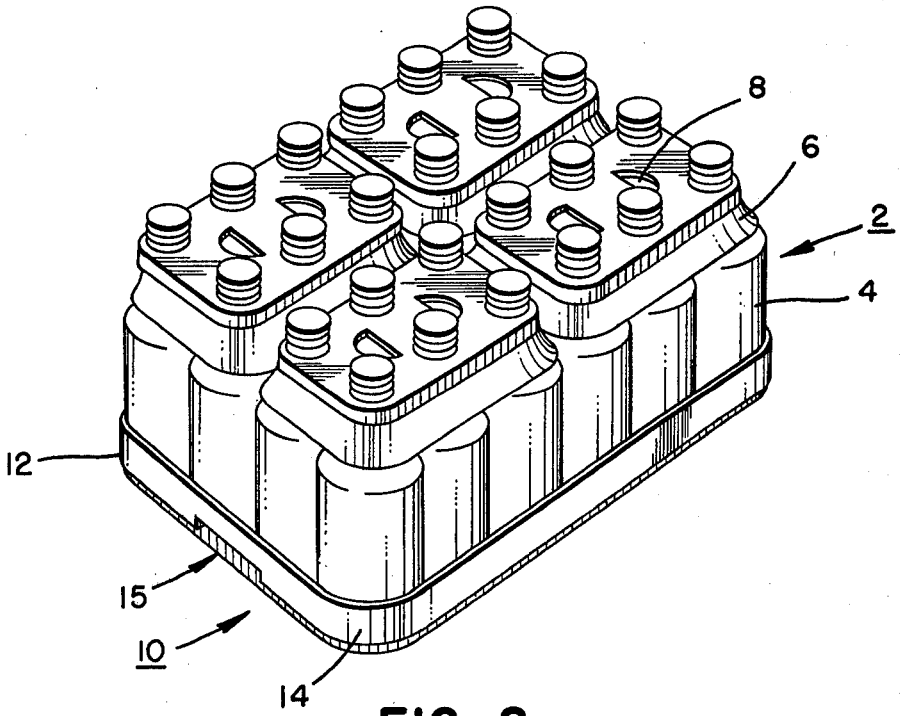
FIG. 1 is a perspective view of a preferred case of the invention containing four six-packs of bottles.

Turning now to FIG. 1, a case 10 of the invention is adapted to hold four six-packs 2 of bottles 4. Each six-pack 2 is of the unsupported-base type described above, having a multipack bottle holder 6 located above a horizontal midplane passing through the bottles 4 of the multipack when the bottles are standing upright.

The case 10 includes an outer wall 12 which is generally rectangular in shape. The corners 14 of the outer wall 12 are rounded for strength and to conserve the material out of which the case is constructed.

Figure 3:
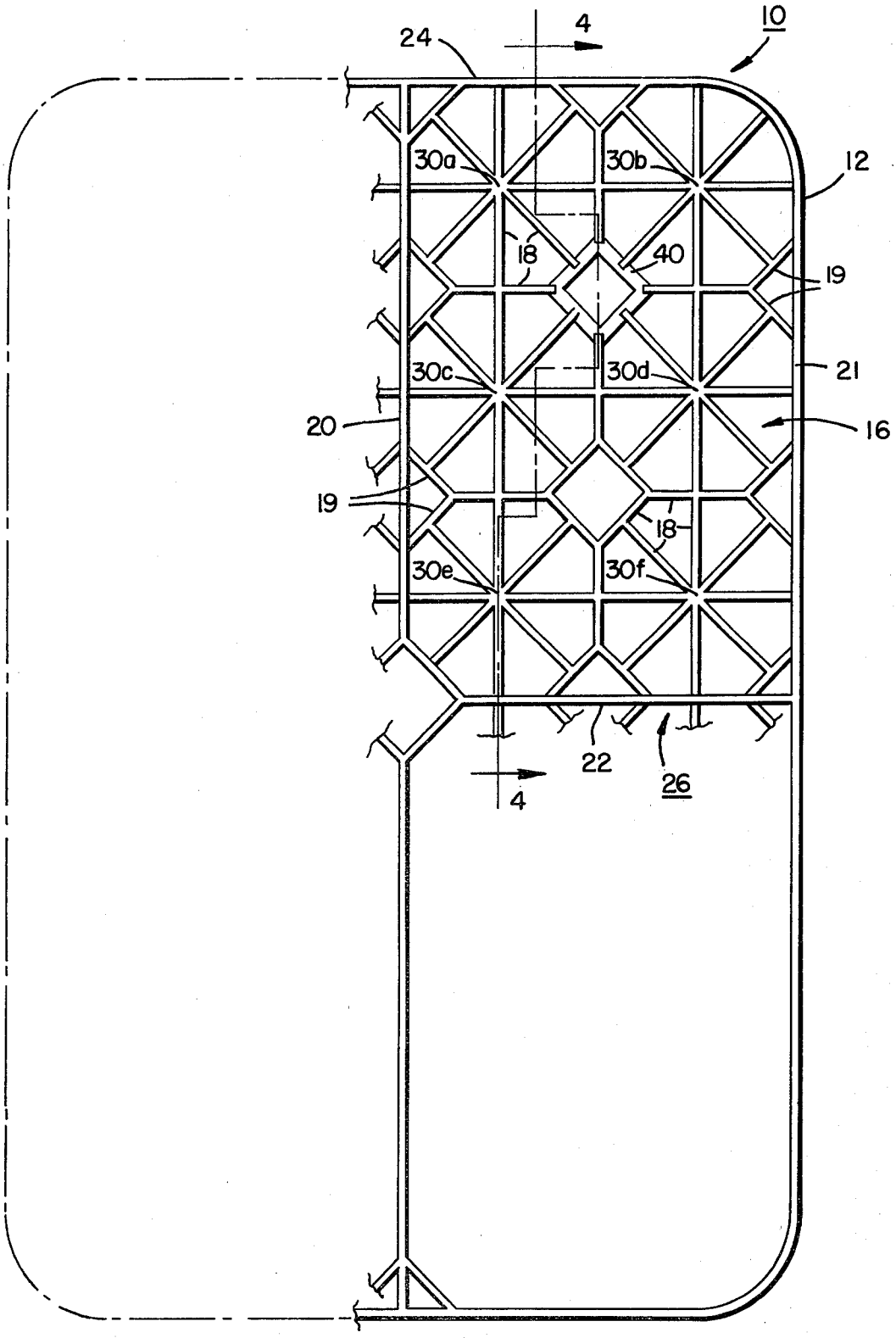
FIG. 3 is a top view of the case of FIG. 1 in which one six-pack receptacle is illustrated in detail. The detail of the remaining three six-pack receptacles of the case may be found by reflecting the receptacle shown through end-to-end and side-to-side midplanes of the case.
Figure 5:
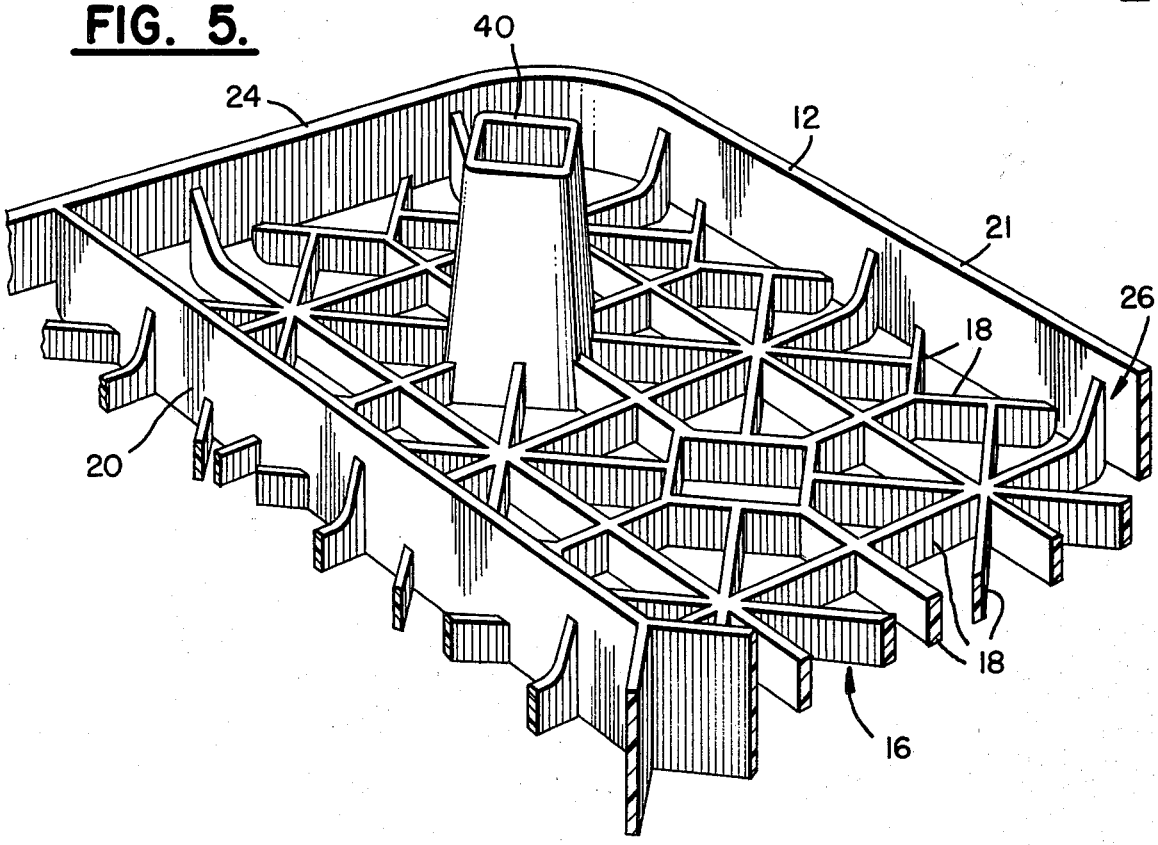
FIG. 5 is a perspective view of a six-pack receptacle of the case of FIG. 1.

As shown in FIGS. 3 and 5, a base grid 16 comprises a plurality of support ribs 18. The support ribs 18 are interconnected to form a grid network for supporting bottles which rest upon a bottle support side of the base grid. A side of the base grid 16 opposite to the bottle support side defines a case-rest side of the base grid.

A first case partition wall 20 extends generally parallel to a side portion 21 of the outer wall 12. A second partition wall 22 extends generally perpendicular to the first partition wall 20 and generally parallel to an end portion 24 of the outer wall 12. The first and the second partition walls 20 and 22 are connected to the base grid 16 and to the outer wall 12. The first and the second partition walls 20 and 22 divide the case 10 into four six-pack receptacles 26, only one of which is shown in detail in FIGS. 3 and 5.

A square lattice of vertex points 30*a*–30*f* can be defined relative to the outer wall 12 of the case 10. The squares of the lattice are dimensioned to correspond to the spacing of the bottles 4 in the six pack 2. When a six pack 2 is inserted in the six-pack receptacle 26, the bottles are substantially centered with respect to the vertex points 30. Each support rib 18 which extends to a vertex point 30 has an indentation surrounding the vertex point in an edge of the rib facing the case support side of the base grid. The indentations in the support ribs extending to a vertex point 30 define a closure-locating dimple 32 associated with the vertex point. The closure locating dimple 32 is shaped to receive a top portion of a closure 34 of a bottle 4.

Figure 4:
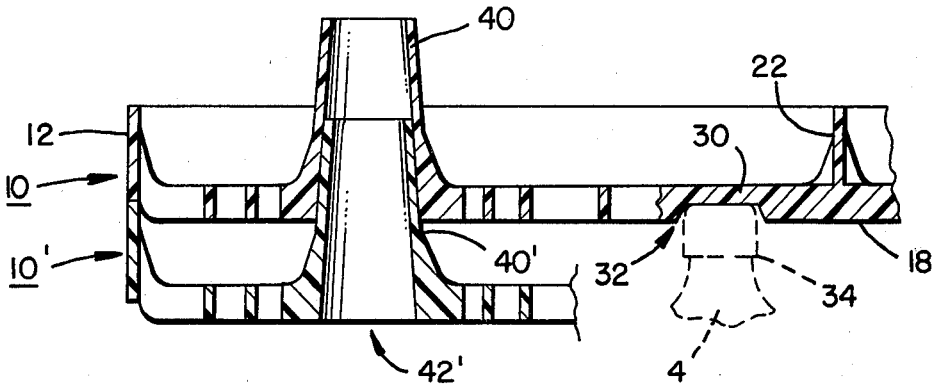
FIG. 4 is a side view in section of the case of FIG. 3 taken along line 4. The case of FIG. 3 is shown resting on top of a second case shown in the section along the same line.

A supporting pillar 40 is connected to the base grid 16 and is located centrally within the six-pack receptacle 26. The supporting pillar 40 is located substantially in the center of a lattice square defined by four vertexes 30*a*, 30*b*, 30*c*, and 30*d*. The supporting pillar 40 has the shape of a truncated pyramid and extends to a point beyond the limit plane of the outer wall 12. The sides of the pyramid are oriented at approximately 45° relative to the side and end portions 21 and 24 of the outer wall 12, as shown in FIG. 5. The supporting pillar 40 is dimensioned to fit within a space between four bottles of a six-pack which is placed within the six-pack receptacle 26 of the case 10. The supporting pillar 40 is hollow. The base grid 16 has a pillar-insert opening 42 passing through it which it communicates with the hollow interior of the supporting pillar 40. As shown in FIG. 4, two cases 10 and 10' of the invention can be nested one on top of the other with a supporting pillar 40' of a lower case 10' extending through the pillar-insert opening 42 of the upper case 10 into the interior of the supporting pillar 40.

Figure 2:
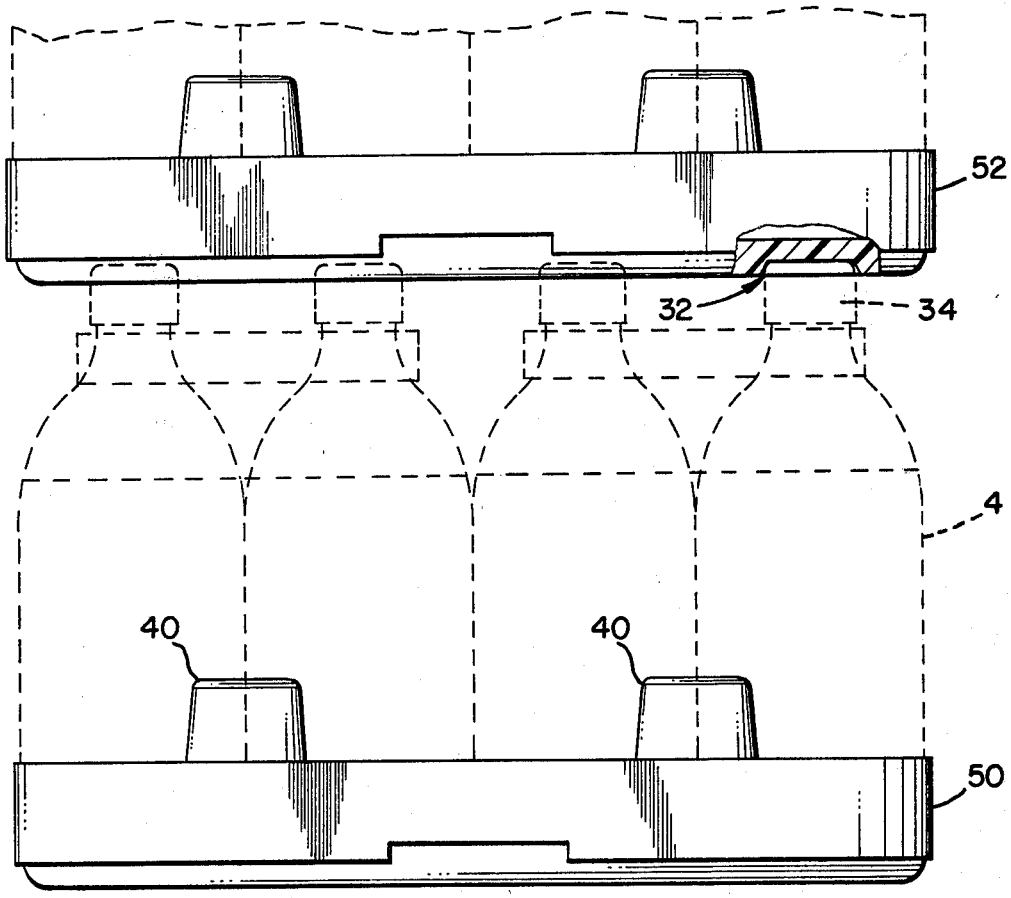
FIG. 2 is an end view of two cases of the embodiment of FIG. 1 which are stacked one on top of the other, with bottles in the cases shown in phantom.
Figure 6:
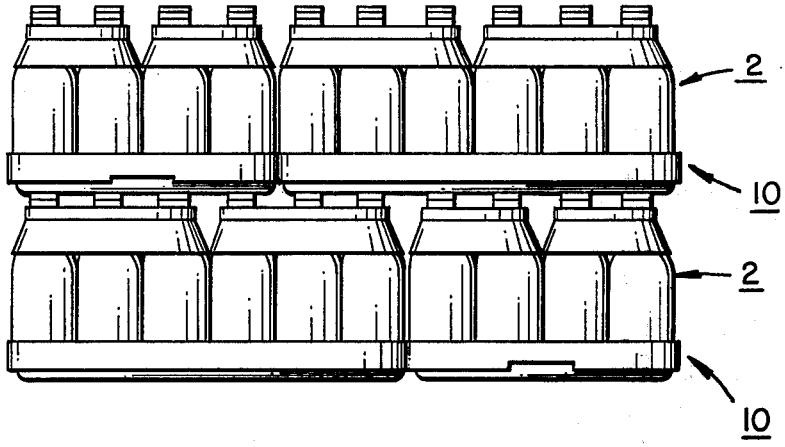
FIG. 6 illustrates four cases of the invention loaded with six-packs in a cross-stacked structure.

As shown in FIG. 2, supporting pillars 40 orient bottles of the six-packs inserted in the case in an upright direction, so that a first case 50 and a second case 52 loaded with multipacks of bottles can be stacked stably one on top of the other. Tops of the bottle closures 34 of the bottles placed in the lower case 50 fit within the closure-locating dimples 32 of the upper case 52. As shown in FIG. 6, cases of the invention may be arranged in a cross-stacked structure, with cases in an upper layer extending perpendicular to the cases in the layer immediately below. Such cross-stacked structures are particularly stable.

It is not intended to limit the present invention to the specific embodiment described above. For example, many other arrangements of the support ribs making up the base grid are possible. It is ordinarily preferred that the support ribs be located sufficiently close to one another to form a grid network in which the openings of the network which face the case-rest surface, other than possibly the pillar-insert openings, are too small to permit a bottle closure mounted on a bottle to penetrate an opening. Consequently, if a first case of multipacks is placed out of alignment on top of a second, correcting the alignment is not hindered by the tops of bottles of the second case becoming wedged between the support ribs of the first case. Bottle base locating depressions can be molded in the bottle-support surface of the base grid if desired. Certain support ribs can be extended in the case-upright direction to guide the multipacks, if desired. For example, base ribs 19 of FIG. 3 can be extended in the case-upright direction to the height of the outer wall 12 to locate the bottles in the six-pack receptacle more securely. More than one supporting pillar can provided in each multipack receptacle. Cases of the invention can be configured to hold multipacks having other than six bottles and can be configured to hold other than four multipacks. It is recognized that these and other changes may be made in the case specifically described herein without departing from the scope and teaching of the instant invention, and it is ended to encompass all other embodiments, alternatives, and modifications consistent with the invention.

I claim:

1. A case for unsupported-base multipacks of bottles, each multipack having at least four bottles located in a generally rectangular array of at least two rows and a multipack bottle holder to which the bottles of the multipack are removably attached, each bottle of the multipack having a bottle closure which extends above the multipack bottle holder when the bottles are standing upright, the multipack bottle holder being located above a horizontal midplane passing through the bottles of the multipack when the bottles are standing upright so that when the multipack is lifted by the multipack-bottle holder, the bases of the bottles are unsupported; the case being molded from a plastic material and comprising:

(a) a generally rectangular outer wall enclosing an area sufficient to encompass at least two multipacks of bottles standing upright side-by-side;

(b) a base grid comprising a plurality of ribs interconnected to form a grid network, a first side of the base grid defining a bottle-support surface and an opposite side of the base grid defining a case-rest surface, a case-upright direction being defined generally normal to the base grid in the direction from the case-rest surface towards the bottle-support surface, the outer wall being connected to the base grid generally along a perimeter of the base grid, the outer wall projecting generally away from the base grid in the case-upright direction, an outer-wall limit plane being defined as a lowest horizontal plane which the outer wall does not extend above when the case is resting on a horizontal surface, the case-support surface having a plurality of indentations therein defining closure-locating dimples, each closure-locating dimple being shaped to receive a top portion of a bottle closure, a square lattice of vertex points being defined in fixed geometric relationship to the outer wall, the closure-locating dimples being located substantially at the vertex points of squares of the lattice, the squares of the lattice being dimensioned substantially to correspond to the spacing of the bottles in a multipack;

(c) case-partitioning means connected to the outer wall and the base grid for partitioning the case to define a plurality of multipack receptacles, the case partitioning means projecting generally away from the base grid in the case-upright direction, each multipack receptacle being shaped to receive the bases of the bottles of a multipack with a centerline of each bottle of the multipack passing at least approximately through a vertex point of the lattice of vertex points, the outer wall being shaped relative to the lattice of vertex points to permit a plurality of such cases with multipacks inserted in the multipack receptacles to be arranged in a multilayered cross-stacked structure with the closures of the bottles of the cases of a lower layer being located in closure locating dimples of the cases in a next higher layer;

(d) a plurality of supporting pillars, each multipack receptacle having a supporting pillar located within it substantially at a center of a square of the lattice of vertex points, the supporting pillars being connected to the base grid and projecting generally away from the base grid in the case-upright direction to a point beyond the outer-wall limit plane, each supporting pillar being shaped and dimensioned to fit within a space between four bottles of a multipack inserted in the multipack receptacle and urge against a side portion of each of the four bottles to stabilize the multipack, the four bottles being located respectively at the four vertex points of the square of the lattice in which the supporting pillar is located, each supporting pillar being generally hollow with crosswise dimensions of the supporting pillar generally decreasing as the distance from the base grid increases, the base grid having a pillar-insert opening passing through it adjacent to each supporting pillar which provides communication with the hollow interior of the supporting pillar, the supporting pillars and the pillar-insert openings being shaped so that two empty cases may be nested one on top of the other with each supporting pillar of the lower case projecting through a pillar-insert opening and into the hollow interior of a corresponding supporting pillar of the upper case.

2. The case according to claim 1 in which the outer-wall limit plane passes below a bottle-midheight point defined by a point on an axial symmetry axis of a bottle standing upright in the case at a distance from the top of a closure of the bottle equal to one half the height of the bottle.

3. The case according to claim 2 in which each multipack receptacle of the case has exactly one supporting pillar located within it.

4. The case according to claim 3 in which each supporting pillar has a truncated pyramidal shape with the faces of the pyramid oriented at approximately 45 degrees relative to the sides of the squares of the lattice of vertex points.

5. The case according to claim 4 in which the bottle-support surface of the base grid is substantially planar.

6. The case according to claim 5 in which the case is configured to hold four unsupported-base six-packs.

* * * * *

UNITED STATES PATENT AND TRADEMARK OFFICE

CERTIFICATE OF CORRECTION

PATENT NO. : 4,410,099

DATED : October 18, 1983

INVENTOR(S) : Pierre J. deLarosiere

It is certified that error appears in the above—identified patent and that said Letters Patent is hereby corrected as shown below:

Column 1, Line 61, "guage" should read --"gauge"--.

Column 1, Line 63, "guage" should read --"gauge"--.

Column 1, Line 68, "guage" should read --"gauge"--.

Column 3, Line 8, "Eack" should read --"Each"--.

Column 4, Line 21, "imprinted" should read --"imprinted on"--.

Column 6, Line 15, "pillar can" should read --"piller can be"--.

Column 6, Line 22, "ended" should read --"intended"--.

Signed and Sealed this

*Thirtieth* Day of *October 1984*

[SEAL]

*Attest:*

GERALD J. MOSSINGHOFF

*Attesting Officer*

*Commissioner of Patents and Trademarks*